United States Patent [19]

Kosecoff

[11] Patent Number: 5,026,047

[45] Date of Patent: Jun. 25, 1991

[54] QUICK RELEASE MECHANISM FOR BICYCLE TRAINER

[76] Inventor: Irving W. Kosecoff, 2852 Sawtelle Blvd., No. 25, Los Angeles, Calif. 90064

[21] Appl. No.: 414,916

[22] Filed: Sep. 29, 1989

[51] Int. Cl.[5] ..... A63B 21/00

[52] U.S. Cl. ..... 272/73; 434/61

[58] Field of Search ..... 272/73, DIG. 4, 131, 272/132; 434/61; 211/1, 17, 22

[56] References Cited

U.S. PATENT DOCUMENTS 4,834,363 5/1989 Sargeant et al. ..... 272/73

4,898,379 2/1990 Shiba ..... 272/73

FOREIGN PATENT DOCUMENTS 0341752 11/1989 European Pat. Off. ..... 272/73

OTHER PUBLICATIONS

Blackburn APX advertisement from Bicycling, Dec. 1985, p. 17.

*Primary Examiner*—Stephen R. Crow

*Attorney, Agent, or Firm*—Pretty, Schroeder, Brueggemann & Clark

[57] ABSTRACT

A secure but inexpensive quick release mechanism for a bicycle trainer includes a cam housing secured to a trainer support base, a cam follower that securely engages a bicycle rear axle and is slideable between opposite engagement and release positions and a rotatable cam connected to drive the cam follower between the engagement and release positions in response to rotation of the cam. The trainer further includes an adjustable fastener supported on the base on a side of a bicycle rear axle opposite the quick release mechanism and a fan mechanism coupled to be driven by a supported wheel to provide a drag that increases with wheel rotational velocity.

15 Claims, 5 Drawing Sheets

QUICK RELEASE MECHANISM FOR BICYCLE TRAINER

BACKGROUND OF THE INVENTION

Bicycle trainers have become popular training devices among bicycle enthusiasts and others as a means of providing physical training for the body. Bicycle trainers are compact devices that can be easily stored and used when needed to provide physical conditioning for a bicycle rider. They can be used advantageously indoors during inclement weather, after dark or at other times when normal bicycle riding is impractical or inconvenient.

A bicycle trainer includes a base that attaches to and supports a rear axle of a bicycle. A rotatable fan, electromagnetic generator or other drag inducing device is coupled to be driven by the rotating rear wheel of the bicycle so as to provide a drag force that increases with rotational velocity of the wheel. A bicycle trainer is commonly referred to as a wind trainer or mag trainer, depending upon the drag inducing device that is used. Unlike most fixed place bicycles, which have a constant force frictional drag mechanism, a wind trainer or mag trainer can closely simulate actual riding conditions by varying the drag force with the wheel speed much as wind resistance would increase with bicycle speed during normal riding. Furthermore, because a bicycle trainer attaches to an actual bicycle, a rider can train on the bicycle that will be used for actual riding activity. A bicycle trainer is also more compact and more easily stored than a fixed place bicycle since it does not include the pedal, seat and handlebar mechanisms, these features being provided by the detachable bicycle.

While bicycle trainers have proven popular and advantageous among bicycle riders, the mechanism for attaching a bicycle trainer to a bicycle has remained inconvenient. Because variations occur in axle sizes, the bicycle trainer engagement mechanism must be adjustable so as to accommodate different sizes.

The engagement mechanism has typically used two holding mechanisms, one on each side of a bicycle rear axle. Typically a cone nut is secured directly to the base on one side of the wheel and a cone nut is held by a threaded bolt on the other side. The bolt is threadedly secured to the base so that by rotating the bolt the cone nut can be moved between an adjustable engagement position and a release position. A lock nut may be used to secure the bolt against further rotation once it is in the engagement position.

This arrangement has proven inconvenient for mounting and detaching a bicycle. It is somewhat time consuming and poses the danger that the mechanism will not be properly adjusted in the engagement position or will come loose during training, thus allowing the bicycle to fall unexpectedly.

The present invention provides a cam driven quick release mechanism that allows a bicycle trainer to be adjusted once to a particular bicycle axle size. Thereafter the cam is operated to quickly and securely engage or release the bicycle axle. Readjustment is required only when different bicycles are used and the engagement is rapid and secure.

SUMMARY OF THE INVENTION

A bicycle trainer in accordance with the invention includes a base having secured thereto a first holding mechanism having an adjustable fastener receiving and supporting one end of a bicycle rear wheel axle on one side thereof, a second holding mechanism having an adjustable cam driven quick release mechanism receiving and supporting an opposite quick release end of the bicycle axle and a fan or other drag mechanism coupled to be driven by rotation of the bicycle rear wheel and induce a drag force that increases with the velocity of rotation of the wheel.

The quick release mechanism has a central axis aligned with the bicycle axle and includes a cone nut fastener adapted to engage the end of the axle in facing mating relationship and secure the end of a bicycle axle to the cone nut. The fastener is axially positioned by a cam and follower mechanism that is secured to the base of the trainer.

The second, quick release holding mechanism includes a housing, a cam follower, a cam having a handle to facilitate convenient manual rotation of the cam between engagement and release positions, and a cone nut fastener and a connector assembly coupling the cam follower to the cone nut. The connector assembly includes a plunger slideably disposed within the housing between cone nut and the cam follower and an adjustable, threaded connection between the cone nut and the plunger. The bicycle trainer base supports the housing, which has an internal cylindrical bore that is axially aligned with a bicycle axle mounting position. The plunger is an elongated cylindrical member with a longitudinally extending threaded internal cylindrical bore at the end that is adjacent the cone nut and opposite the cam follower. The cone nut is mounted on the end of a threaded shaft that adjustably matingly engages the bore in the end of the plunger. A slotted end of the plunger receives the cam follower which in turn axially moves the plunger and attached cone nut between engagement and retracted positions in response to rotation of the cam. A yoke arrangement pivotably secures the cam to the housing.

The cam follower is axially positioned between engagement and release positions as the cam is rotated approximately 90 degrees between corresponding engagement and release cam positions. The cam slot has a detent formed at the engagement position thereof to assure stable, secure engagement of the fastener with a bicycle rear axle.

BRIEF DESCRIPTION OF THE DRAWINGS

A better understanding of the invention may be had from a consideration of the following Detailed Description, taken in conjunction with the accompanying drawings in which.

DETAILED DESCRIPTION OF THE INVENTION

Figure 1:
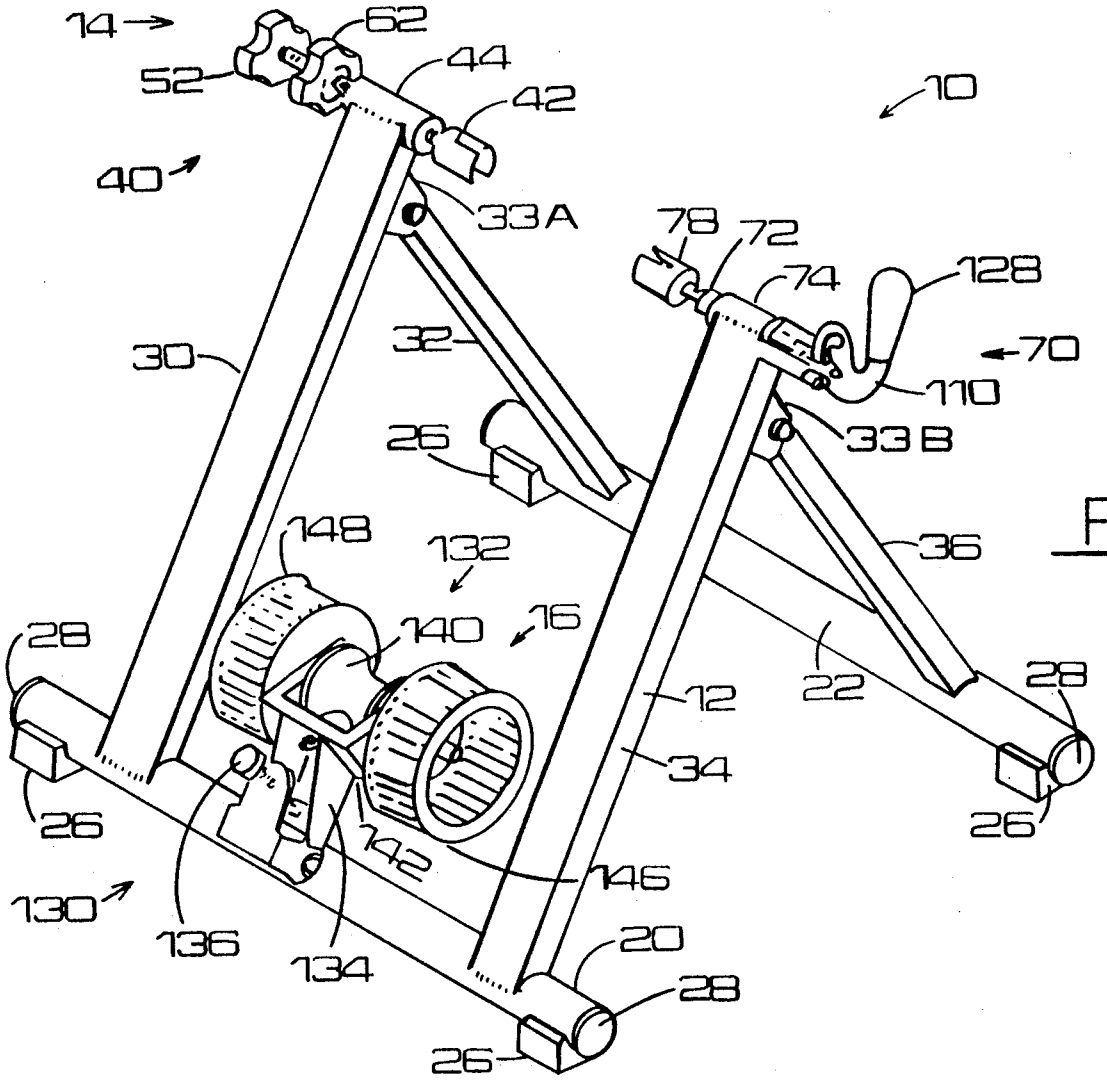
FIG. 1 is a perspective view of a bicycle trainer having a quick release mechanism and a U-shaped drive roller in accordance with the invention.

Referring now to FIG. 1, a bicycle trainer 10 in accordance with the invention includes a base 12, a connector assembly 14 that releasably secures the trainer 10 to the rear axle of a bicycle, and a drag inducing resistance assembly 16 that engages the rear wheel of a bicycle and provides a rotational drag that increases with rotational velocity.

The base 12 provides in effect two spaced apart A frames supported by two horizontally extending 1¼ inch diameter cylindrical tube floor members 20, 22. Each floor member 20, 22 is a 20 inch long straight tubular member of steel or other adequately strong material with a rubberized cleat 26 adjacent each end to increase frictional engagement with the floor and dampen vibration to prevent motion or walking during use. Each cleat 26 has a flat sole on the bottom and a cylindrical bore on top that is closed through an arc greater than 180 degrees so that the cleat 26 can snap onto and be retained by one of the cylindrical floor members 20, 22. An end cap 28 covers the ends of each of the floor members 20, 22 to improve the esthetic appearance of trainer 10 and protect against damage to furniture or other items.

A first A frame is formed by two rectangular leg members 30, 32 extending perpendicularly from the floor members 20, 22, respectively, about 5½ inches from a first end thereof. The leg members 30, 32 are secured to floor members 20, 22 by welding or other suitable means. Leg member 32 is hingedly secured to leg member 30 near the top thereof to form an apex for the A. A bracket 33A limits the leg members from rotating open to beyond an angle that provides an approximately 16 inch spacing between the floor members 20, 22. This spacing is sufficient to provide a stable support.

A second A frame similar to the first is formed by two rectangular tube leg members 34, 36 welded respectively to floor members 20, 22 perpendicular thereto and parallel to leg members 30, 32, respectively. The point of securement is approximately 5½ inches from a second end of floor members 20, 22 opposite the first end. Leg member 36 is hingedly secured to leg member 34 near the top thereof by a bracket 33B which limits the spacing of floor member 20, 22 to approximately 16 inches.

Figure 2:
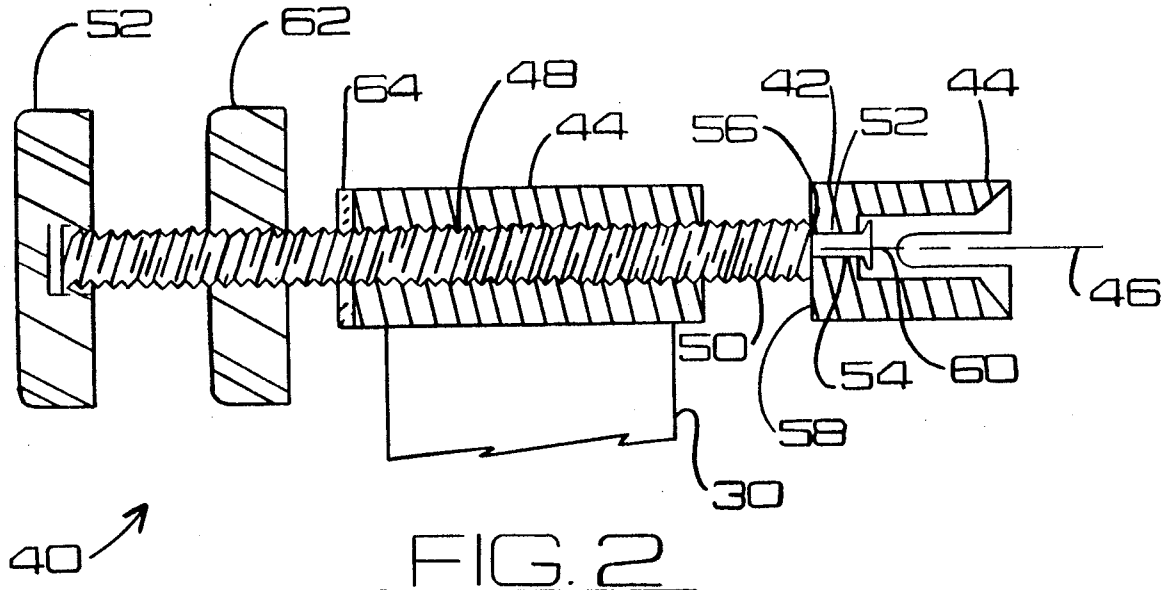
FIG. 2 is a fragmentary sectional view of a first adjustable holding mechanism used in the trainer shown in FIG. 1.

Making additional reference now to FIG. 2, a first holding mechanism 40 of connector assembly 14 is secured by welding or other suitable means to an upper end of leg 30 which extends a short distance above the hinge connection to leg member 32. Holding mechanism 40 includes a conventional cone nut 42. Cone nut 42 has an interior conical bore 44 in an engagement end thereof which receives and secures a left end of a bicycle rear axle.

A 2¼ inches by 1 inch diameter cylindrical housing 44 is welded to the upper end of leg member 30 with a longitudinally extending central axis 46 positioned for alignment with the central axis of a rear bicycle axle that is to be secured to trainer 10. Housing 44 has a longitudinally extending central bore 48 therethrough that is threaded and matingly receives a threaded, cylindrical shaft 50. Shaft 50 is secured at an outer end to a handle 52 and at an opposite inner end to the cone nut 42.

The inner end of shaft 50 has a reduced diameter portion 52 which is received with a loose fit by a bore 54 until a shoulder 56 at the transition between the main portion and the reduced diameter portion 52 of shaft 50 engages an outward end 58 of cone nut 42. After the end portion 52 is inserted into bore 54, a flair 60 is formed on the end of shaft 50 to retain cone nut 42 loosely and rotatably secured to the end portion 52 of shaft 50. Shaft 50 may thus rotate relative to cone nut 42 without requiring cone nut 42 to rotate relative to a bicycle axle to which it might be secured.

A lock nut 62 with a large outer diameter that facilitates gripping, threadedly engages shaft 50 on the outer side of housing 44 and a 1 inch outer diameter washer 64 is disposed about shaft 50 between lock nut 62 and housing 44. With lock nut 62 loosened handle 52 can be used to rotate shaft 50 until the threads cause it to be moved to a desired axial or longitudinal position relative to housing 44. Once the cone nut 42 is adjusted to the desired position, lock nut 62 is tightened against washer 64 add housing 44 to lock the selected adjustment and prevent vibrationally induced further rotation of shaft 50.

Figure 3:
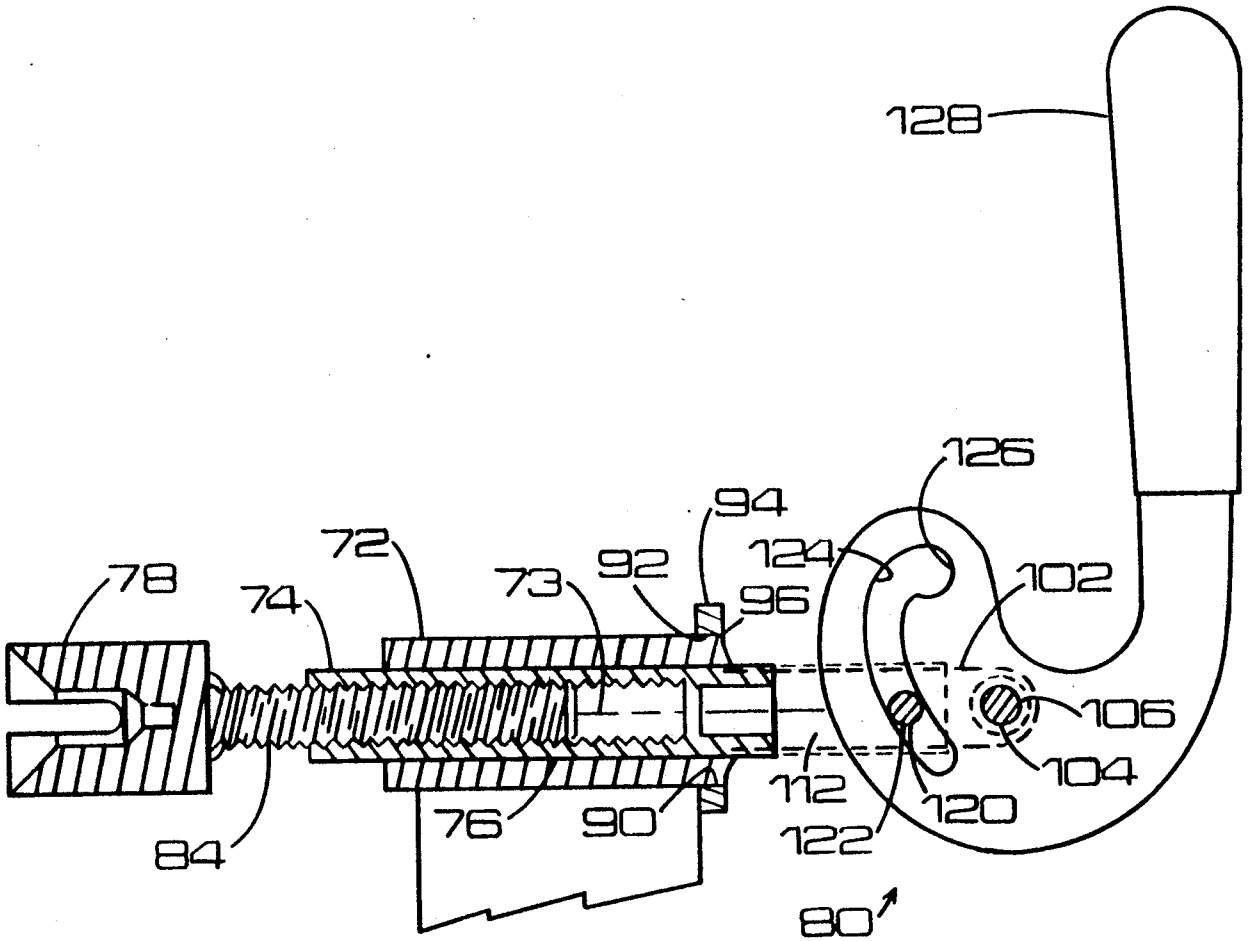
FIG. 3 is a fragmentary sectional view of a second, adjustable, quick release holding mechanism used in the trainer shown in FIG. 1.

Making further reference now to FIG. 3, the second portion 70 of connector assembly 14 includes a 2¼ inch diameter by 1 inch diameter cylindrical housing 72 welded to the upper end of leg member 34 a short distance above the hinge connection to leg member 36 and extending along a longitudinal axis 73, an elongated cylindrical plunger 74 extending through a central bore 76 passing longitudinally through housing 72, a cone nut 78 threadedly and adjustably secured to plunger 74 and a cam and follower assembly 80 disposed on the outside of housing 72 opposite cone nut 78 to conveniently and quickly release or secure cone nut 78 relative to an end of a bicycle rear axle.

A threaded shaft 84 is welded to an outward end of cone nut 78 and matingly engages a threaded, longitudinally extending cylindrical bore 76 in the inward end of plunger 84. Cone nut 78 may thus be axially adjustably positioned relative to plunger 74 by rotating cone nut 78 and threaded shaft 74 until a desired longitudinal or axial position is attained.

The quick release cam and follower mechanism 80 selectively and easily moves the plunger 74 and hence cone nut 78 between an adjusted engagement position and a release position which enables a bicycle to be readily removed from trainer 10. Housing 72 has an outer end portion 90 which extends a short distance beyond leg member 34 so as to matingly receive and be inserted into a central bore 92 of a collar 94 of a yoke 96. Collar 94 is suitably secured, as by welding, to housing 72.

Yoke 96 further includes two spaced apart fingers 100, 102 extending outwardly from collar 94, finger 100 being mostly broken away for ease of viewing other portions of the cam and follower mechanism 80. Fingers 100, 102 are approximately 7/16 inch high and 2¼ inches long. Each finger 100, 102 has located near the outward end thereof a bore. A bolt 106 passes through both of these bores 104 as well as through a pivot hole 108 in a cam 110 that is disposed in a slot: defined between the two fingers 100, 102. A pair of cylindrical hollow spacers are also dispensed on the bolt, one between the cam 110 and each of the fingers 100, 102, to maintain cam 110 centered between the fingers 100, 102.

Plunger 74 has a slot 112 in the outer end thereof having sufficient width and depth to freely receive cam 110 as cam 110 rotates about pivot hole 108 and bolt 106 passing therethrough. Plunger 74 also has a pair of transverse holes 120 near the outer end thereof. A cam follower bearing 122 extends through the pair of holes 120 and also through a cam slot 124 in cam 110. Cam follower bearing 122 is a rivet having a head on one end on one side of the plunger 74 and a flair in the opposite end so that it remains constrained within the holes 120 and a slot 124 of cam 110.

The cylindrical portion of plunger 74 that slides within bore 76 of housing 72 has an outer diameter of approximately $\frac{5}{8}$ inch. To attain smooth, nonbinding action as plunger 74 slides within bore 76, the length of bore 76 should be greater than and preferably at least twice the diameter of plunger 74.

Figure 4:
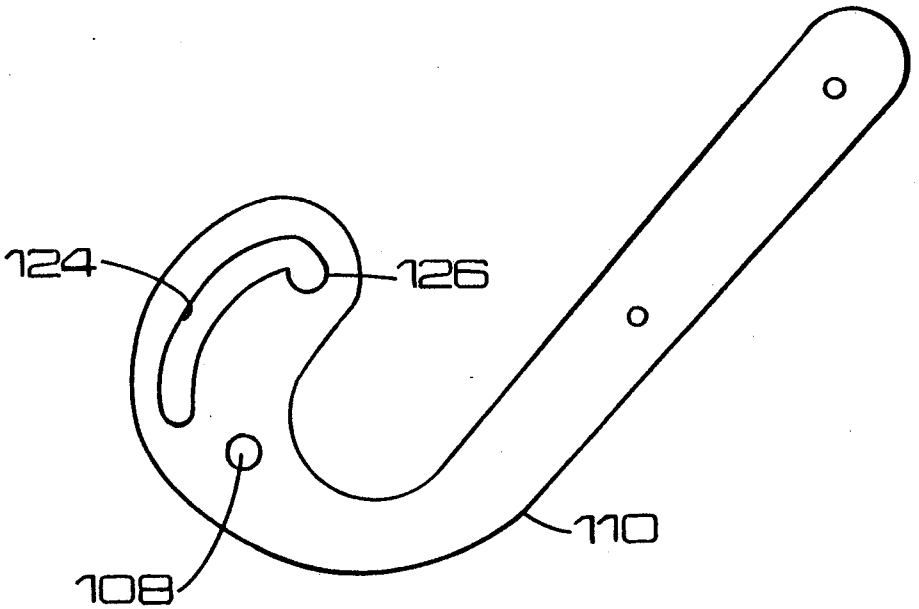
FIG. 4 is a plan view of a slotted cam with a handle used in the quick release holding mechanism shown in FIG. 3.

As seen more clearly in FIG. 4, cam slot 124 is shaped such that cam follower bearing 122 and the attached plunger move inwardly and outwardly approximately 1 inch as cam 110 rotates approximately 90 degrees between retracted and securement positions. Cam slot 124 is approximately $\frac{1}{4}$ inch wide, but has an enlarged detent recess 126 on one side thereof at the securement end. Recess 126 provides a detent which prevents the cam mechanism 80 from accidentally opening due to small vibrations once a bicycle has been properly secured therein. Cam 110 has a handle 128 for convenient use in controlling the rotation thereof by an operator. The use of a cam slot 124 provides in effect two cam surfaces, one for forcing the fastener 78 toward the engagement position and one for forcing the fastener 78 toward the release position. This avoids the need for a spring or other device which biases the cam follower toward a single cam surface in order to control bidirectional motion.

Referring now to FIG. 1, a drag inducing mechanism 130 includes a fan assembly 132 adjustably secured to floor member 20 of base 12. Fan assembly 132 is bolted or otherwise secured to the end of a pivot arm 134 which may be adjustably positioned in response to an adjusting screw 136. Adjusting screw 136 rotates the fan assembly 132 closer to or farther from a secured bicycle axle so as to accommodate variations in wheel and tire sizes so as to maintain a secure, but not overly tight, engagement between a mounted bicycle rear tire and a $2\frac{5}{8}$ inch diameter U-shaped cross section urethane drive roller 140 of fan assembly 132. Centrally, the U-shape defines a circular arc with a radius of 1 inch.

Figure 5:
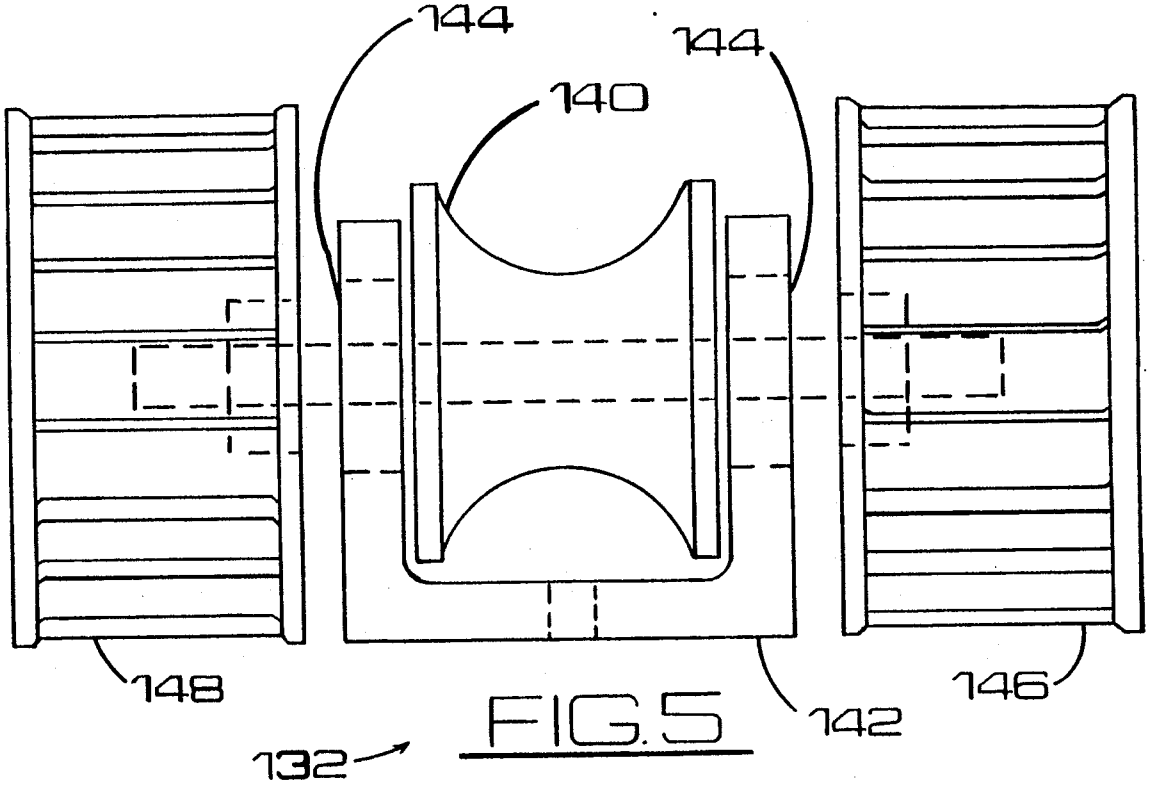
FIG. 5 is a front view of a fan type drag inducing device with a U-shaped cross section drive roller used in the bicycle trainer shown in FIG. 1.

Fan assembly 132, as shown in FIG. 5, further includes an approximately $\frac{3}{8}$ inch thick, channel shaped mounting bracket 142 having in the two upright walls thereof a pair of bearings 144 which rotationally receive and mount a drive shaft 145 which passes therethrough, which passes through and engages drive roller 140 and which engages and supports a pair of fans 146, 148 on opposite ends thereof. The fan assembly 132 is of relatively heavy and strong construction to help suppress vibrations which result from a combination of minor imbalances and high speed rotation thereof. Drive roller 140 is approximately $2\frac{1}{8}$ inches wide, has an outer diameter of approximately $2\frac{5}{8}$ inches at the ends thereof and a minimum outer diameter of approximately $1\frac{1}{8}$ inches at the center thereof. The U-shaped recess is approximately $1\frac{7}{8}$ inch wide at the circumference.

The U-shaped drive roller 140 provides superior performance compared to a conventional flat cylinder drive roller because it wraps part way around the bicycle tire to help maintain constant, smooth contact. A currently popular tire design employs a knobby tire tread which places a relatively large bead or knob at intervals alternating with openings. The beads also alternate on opposite sides of the tire. As such a tire rotates against a flat cylinder drive roller, a detent action tends to occur between each pair of adjacent knobs.

This creates an annoying vibration and possibly an annoying noise emission as the trainer is used. The wrap around effect of the U-shaped roller engages the side walls as well as the bottom surface of a tire to provide a much more smooth and continuous engagement between the rear bicycle tire of a mounted bicycle and the U-shaped drive roller 140.

As the tire rotates against roller 140, roller 140 rotates to drive shaft 145 and in turn the two fans 146, 148 The fan rotation thus increases with tire rotation speed to produce a drag that increases with tire rotation speed to simulate the resistance that occurs when actually riding a bicycle. It will be appreciated that other drag mechanisms such as a conventional electromagnetic drag mechanism could also be coupled to drive roller 140.

When a bicycle is first mounted on trainer 10, the threaded screw adjustments of the first and second holding mechanism 40, 70 of connector assembly 14 are adjusted to center the rear bicycle wheel relative to drive roller 140 and to assure a proper holding force when the connector assembly 14 is closed. Thereafter, the bicycle can be removed from or reconnected to the bicycle trainer 10 by merely rotating handle 128 of cam 110 to release or secure the bicycle. If a different bicycle is to be mounted, the connector assembly can be readjusted to accommodate any variations in the length of the rear axle or the position of the rear axle relative to the rear wheel.

While there has been shown and described above a particular arrangement of a bicycle trainer in accordance with the invention for the purpose of enabling a person of ordinary skill in the art to which the invention pertains to make and use the invention, it will be appreciated that the invention is not limited thereto. Accordingly, any modifications, variations or equivalent arrangements within the scope of the attached claims should be considered to be within the scope of the invention.

What is claimed is:

1. A quick release mechanism for a bicycle trainer comprising:

a fastener that is axially moveable between an engagement position at which the fastener engages and securely holds an axle of a bicycle and an axially displaced release position;

a handle that is positionable at engagement and release positions; and a linkage coupled to control axial movement of the fastener between the engagement and release positions in response to positioning of the handle at engagement and release positions respectively, the linkage including a threaded shaft supporting the fastener at one end thereof, the axial position of the threaded shaft being adjustable to enable adjustable positioning of the fastener the linkage further including a plunger in threaded, adjustable engagement with the threaded shaft at one end and coupled to the handle at a second opposite end, the plunger being axially movable without rotation thereof between engagement and release positions in response to positioning of the handle.

2. A quick release mechanism according to claim 1 wherein the linkage comprises a cam and follower mechanism.

3. A quick release mechanism according to claim 1 wherein the linkage includes a cam coupled to the handle and a cam follower coupled to the fastener and being moveable in response to motion of the cam to cause the fastener to move between the engagement and release positions in response to motion of the cam.

4. A quick release mechanism according to claim 2 wherein the cam and follower mechanism has a detent providing a stable holding force in the engagement position.

5. A quick release mechanism according to claim 1 wherein the fastener includes a cone nut adapted to engage and hold an end of a bicycle axle.

6. A quick release mechanism for a bicycle trainer according to claim 1 further comprising a housing having an axially extending cylindrical bore and wherein the cam and follower mechanism includes the plunger having a cylindrical portion that is matingly and axially moveably disposed within the cylindrical bore, the length of the cylindrical bore being greater than the diameter of the cylindrical portion of the plunger that moves within the bore.

7. A quick release mechanism for a bicycle trainer according to claim 6 wherein the fastener includes a cone nut adapted to engage and hold an end of a bicycle axle and wherein the cone nut is secured to the end of the threaded shaft with freedom to rotate relative to the threaded shaft.

8. A quick release mechanism for a bicycle trainer comprising:

a fastener that is axially moveable between an engagement position at which the fastener engages and securely holds an axle of a bicycle and an axially displaced release position;

a handle that is positionable at engagement and release positions; and a linkage coupled to control axial movement of the fastener between the engagement and release positions in response to positioning of the handle at engagement and release positions respectively, the linkage comprising a cam and follower mechanism including a generally planar cam member that is rotatable about a pivot point in the plane of the cam member, the cam member having a slot that extends about the pivot point for approximately 90 degrees of rotation with a distance from the pivot point that increases from a first extremity at a release position to an opposite extremity at an engagement position, the extremity at the engagement position having a small and sharp decrease in distance from the pivot point forming a detent tending to maintain the cam member in the engagement position, the cam and follower mechanism further including a follower member coupled to follow the radial position of the slot as the cam member rotates, the follower member being further coupled to the fastener and moving the fastener between the engagement and release positions thereof as the cam member correspondingly rotates between engagement and release positions.

9. A quick release mechanism for a bicycle trainer comprising:

a holding mechanism including a cam follower, the holding mechanism being slideably mounted on the bicycle trainer, the holding mechanism having a fastener adapted to engage and secure a rear axle of a bicycle mounted in the trainer, the cam follower being coupled to a cam surface and being coupled to move the fastener between different release and engagement positions in response to motion of the cam surface, the holding mechanism further including means for adjustably connecting the fastener to the cam follower to enable axial positioning of a mounted bicycle at an engagement position of the holding mechanism; and a cam including the cam surface, the cam being pivotably secured to the trainer at a pivot point, the cam surface causing the cam follower to move between the release and engagement positions thereof as the cam rotates between corresponding release and engagement positions of the cam.

10. A quick release mechanism for a bicycle trainer that supports a rear axle of a bicycle on a base, the quick release mechanism comprising:

a housing secured to the base of the trainer, the housing having an axially extending central bore passing therethrough and a yoke extending axially from the central bore on a side of the housing opposite a bicycle mounting position;

a plunger disposed in slideable mating relationship with the central bore and extending past the central bore on each side thereof;

a fastener adapted to engage and support a rear axle of a bicycle secured to the plunger on a side of the plunger adjacent the bicycle mounting position;

a cam follower bearing secured to the plunger on a side thereof opposite the fastener; and a cam pivotably secured to the yoke at a pivot point, the cam having a cam slot that is in engagement with the cam follower, the cam slot being located near the pivot point at one end and farther from the pivot point at an opposite end so as to axially position the cam follower bearing as the cam rotates about the pivot point, the cam further including a handle that facilitates manual rotation of the cam about the pivot point to produce axial motion of the cam follower bearing and fastener between secured and released positions relative to an axle of a bicycle.

11. A quick release mechanism according to claim 10 further comprising an adjustment mechanism disposed between the cam follower bearing and the fastener to enable selective adjustment of a spacing between the cam follower bearing and the fastener.

12. A quick release mechanism according to claim 11 wherein the adjustment mechanism comprises a threaded shaft secured at one end to the fastener, wherein the plunger has a threaded bore in an end thereof adjacent the fastener, and wherein the threaded shaft matingly engages the threaded bore.

13. A quick release mechanism for a bicycle trainer that supports a rear axle of a bicycle on a base and includes a fan coupled to be rotated in response to rotation of the rear wheel of the bicycle so as to produce a drag that increases with rotational velocity of the rear wheel, the quick release mechanism comprising:

a housing secured to the base and having an aperture extending axially therethrough between an engagement side and an opposite control side;

a yoke secured to and extending from the housing on the control side thereof;

a plunger extending through and axially slideable within the aperture extending through the housing, the plunger having an engagement end on the engagement side of the cam housing that is adapted to receive and support a rear axle of a bicycle and an opposite control end;

a fastener adjustably secured to the engagement end of the plunger, the fastener being adapted to securely engage and support an end of a bicycle wheel axle and being axially positionable relative to the plunger to enable axial positioning of a wheel of a bicycle mounted on the base; and a cam having a pivot point, the cam being mounted on the yoke for rotation about the pivot point, the cam further having a cam surface coupled to the plunger on the control end of the plunger, the cam surface having a varying distance from the pivot point such that the plunger is axially moved between a position of securement in which the engagement end engages a rear axle of a bicycle and a release position as the cam is correspondingly rotated between respective securement and release positions.

14. A quick release mechanism for a bicycle trainer comprising:

a first holding mechanism disposed to engage and secure one end of a bicycle rear axle, the first holding mechanism including means for adjusting an axial position at which the rear axle is engaged; and a second holding mechanism disposed to engage and secure an end of the bicycle rear axle opposite the one end, the second holding mechanism including a handle and means including a slidable non-rotating plunger for selectively engaging and releasing the rear axle in response to motion of the handle, the second holding mechanism being coupled to the plunger and further including means for adjusting a position at which the opposite end of the rear axle is engaged by the second holding mechanism.

15. A holding mechanism for selectively engaging and securing an end of a bicycle axle to a bicycle trainer comprising:

a housing having an axially extending bore therethrough, the housing being secured to the trainer with the bore axially aligned with a bicycle axle mounting position;

a generally cylindrical plunger slideably disposed within the bore, the plunger having an axially extending threaded bore in one end thereof and a slot in an opposite end thereof;

a fastener adapted to receive and secure an end of a bicycle axle and one end thereof and having a threaded shaft extending from an opposite end thereof, the threaded shaft being partly disposed within and matingly engaging the bore of the plunger;

a yoke secured to the housing and having a pair of spaced apart fingers extending from a side thereof adjacent the slotted end of the plunger, the fingers extending on opposite sides of the plunger and beyond the slotted end thereof;

a cam having a handle extending therefrom, the cam being pivotably mounted on the fingers at a pivot point and extending between the fingers and into the slot in the end of the plunger, the cam having a cam slot varying in distance from the pivot point; and a cam follower disposed within the cam slot and secured to the plunger to cause the plunger to slide within the housing and move the fastener between engagement and release positions as the cam is rotated about the pivot point between corresponding engagement and release positions respectively.

* * * * *